US007712283B2

(12) United States Patent
Gadd et al.

(10) Patent No.: US 7,712,283 B2
(45) Date of Patent: May 11, 2010

(54) BRACKETS AND BRACKET SYSTEM FOR ASSEMBLING PLAYGROUND EQUIPMENT

(75) Inventors: Scott Gadd, Chattanooga, TN (US); Giovanni Piccione, Janesville, WI (US)

(73) Assignee: Playcore Wisconsin, Inc., Janesville, WI (US)

( * ) Notice: Subject to any disclaimer, the term of this patent is extended or adjusted under 35 U.S.C. 154(b) by 1115 days.

(21) Appl. No.: 11/068,608

(22) Filed: Feb. 28, 2005

(65) Prior Publication Data

US 2006/0191234 A1 Aug. 31, 2006

(51) Int. Cl.
*E04C 2/30* (2006.01)

(52) U.S. Cl. ..... 52/713; 52/703; 52/715; 248/218.4

(58) Field of Classification Search ..... 52/712, 52/713, 714, 702, 370, 704, 703, 715; 403/385, 403/389, 391, 395; 248/124.2, 218.4, 219.4, 248/229.1, 229.16, 227.3, 227.4, 300
See application file for complete search history.

(56) References Cited

U.S. PATENT DOCUMENTS 813,253 A * 2/1906 Sullivan ..... 249/44
1,423,991 A * 7/1922 Brooks ..... 52/370
2,217,055 A * 10/1940 Jennens ..... 403/399
4,289,290 A * 9/1981 Miller ..... 248/251
5,653,079 A * 8/1997 Loeffler et al. ..... 52/712
7,017,876 B1 * 3/2006 LeCher ..... 248/300
7,235,019 B1 * 6/2007 LeCher ..... 472/118
2005/0155314 A1 * 7/2005 Banta ..... 52/720.1

* cited by examiner

*Primary Examiner*—Richard E Chilcot, Jr.
*Assistant Examiner*—Anthony N Bartosik
(74) *Attorney, Agent, or Firm*—Stephen J. Stark; Miller & Martin PLLC

(57) ABSTRACT

A bracket system for assembling playground equipment includes a plurality of deck support brackets, at least two vertical frame brackets, at least two horizontal frame brackets, a swing bracket, and at least two ladder brackets. The deck support brackets secure horizontal deck support beams to vertical frame beams at first points along the vertical frame beams. The vertical frame brackets attach to at least two adjacent vertical frame beams at second points above the first points. The at least two horizontal frame brackets fix at least one horizontal frame beam to the at least two adjacent vertical frame beams at the second points; the horizontal frame brackets and the vertical frame brackets interconnect. The swing bracket fastens a swing support beam to the at least one horizontal frame beam at a third point along the at least one horizontal frame beam. The at least two ladder brackets connect a ladder to one of the horizontal deck support beams.

4 Claims, 5 Drawing Sheets

BRACKETS AND BRACKET SYSTEM FOR ASSEMBLING PLAYGROUND EQUIPMENT

BACKGROUND OF THE INVENTION

The present invention is directed to a bracket system and brackets for assembling playground equipment, and a method for assembling playground equipment using the bracket system. More particularly, the present invention pertains to a bracket system and method of use thereof including several different types of brackets for assembling playground equipment comprising upright posts to which elements such as platforms, ladders, swing beams and the like are secured.

Many different configurations of playground equipment are well known in the art. In many constructions, vertical frame beams or posts provide support for the equipment's individual play units, which may include mounted platforms, towers, ladders, slides, overhead bars, firepoles, ropes, climbing walls, or swing beams. Several of these distinct play units may be interconnected by a single deck, so that a child may reach all of the play units from the same platform. Other units also may be added, including other decks, to enlarge the equipment.

Most known playground equipment is constructed of multiple components, which must be assembled by a user. In all such configurations, many of the components must be attached by hardware or mechanical fasteners such as bolts, screws, or the like. Many types of prior art playground equipment must be pre-assembled during construction, resulting in bulky pieces that are difficult to store and transport. Other types of prior art playground equipment have very complex constructions and connections, requiring the services of a professional with a variety of tools to put it together. Even if a user is supposed to be able to assemble a piece of playground equipment himself, in his own backyard, the means of connecting prior art components to one another frequently is confusing and unclear, with every connector looking the same. Further, owner-assembled playground equipment frequently is not nearly as sturdy or secure as institutional playground equipment, because of sub-par assembly or connecting means.

Accordingly, there exists a need for a rigid, strong, and stable bracket system for assembling modular playground equipment that is simple and straightforward to use. Such a bracket system and method of use thereof allows the playground equipment components together with their brackets to be efficiently and compactly stacked for easy transport and lower shipping costs. Desirably, such a bracket system includes brackets of several different styles, wherein each style is designed to safely and securely connect different types of playground equipment components. Most desirably, such a bracket system and method of use thereof allows users to quickly and easily understand how to assemble their playground equipment; unlike other, prior art means of constructing playground equipment, no professional assistance is required to use the bracket system of the present invention.

BRIEF SUMMARY OF THE INVENTION

A bracket system for assembling playground equipment includes a plurality of deck support brackets, at least two vertical frame brackets, at least two horizontal frame brackets, a swing bracket, and at least two ladder brackets. The deck support brackets secure a plurality of horizontal deck support beams to a plurality of vertical frame beams at first points along the vertical frame beams. The vertical frame brackets attach to at least two adjacent vertical frame beams at second points above the first points. The at least two horizontal frame brackets fix at least one horizontal frame beam to the at least two adjacent vertical frame beams at the second points; the horizontal frame brackets and the vertical frame brackets interconnect.

The swing bracket fastens a swing support beam to the at least one horizontal frame beam at a third point along the at least one horizontal frame beam. The at least two ladder brackets connect a ladder to one of the horizontal deck support beams. Desirably, at least two additional ladder brackets are included, to connect a climbing wall to one of the plurality of horizontal deck support beams.

In a preferred embodiment, the first points are located approximately at a midpoint between a bottom and a top of the vertical frame beams. The second points may be located approximately at a midpoint between the first points and a top of the vertical frame beams. The third point may be located approximately at a midpoint between the at least two horizontal frame brackets.

Preferably, each of the brackets comprising the bracket system comprises a single piece of folded or bent material and creates each individual bracket style. This material may include durable metals and/or plastics. The deck support brackets include a base, a back perpendicularly oriented to the base, and left and right sloping sides. Outer portions of the left and right sides are substantially perpendicular to both the base and the back, but inner portions of the left and right sides fold perpendicularly to the outer portions, overlapping the forming a channel flaps which are separated by a slot above the back. The slot is useful to cooperate with other brackets as will be described below. The base, back, and left and right sides all include holes for receiving fasteners.

The second frame brackets include a back, left and right side walls perpendicular to the back, and short upper and lower front walls perpendicular to the side walls. The upper front wall extends toward the lower front wall spaced by a channel gap, and the lower front wall extends away from the upper front wall. The back and upper and lower front walls as well as the side walls preferably include holes for receiving fasteners.

The second frame brackets include a back, left and lower sidewalls perpendicular to the back, and short lower front walls perpendicular to the side walls. The upper front wall extends toward the lower front wall and the lower front wall extends towards the upper front wall. The back and upper lower front walls as well as the side walls include walls for receiving fasteners.

The swing bracket preferably includes a base, left and right upper back walls extending towards each other and perpendicular to the base, left and right side walls perpendicular to the left and right upper back walls, a lower back wall perpendicular to the base, and a lower front wall perpendicular to the base. The left and right upper back walls, the left and right sloping side walls, the lower back wall, and the lower front wall all include holes for receiving fasteners.

Finally, the ladder brackets include a back, a sloping side wall perpendicular to the back, and a top wall at an obtuse angle to the back. The back, the side wall, and the top wall all include holes for receiving fasteners. A piece of playground equipment assembled with the bracket system and a method for assembling playground equipment also are disclosed. The method preferably includes the steps of securing horizontal deck beams to vertical frame beams with deck support brackets; attaching vertical frame brackets to adjacent vertical frame beams; fixing a horizontal frame beam to the adjacent vertical frame beams; interconnecting the horizontal frame brackets and the vertical frame brackets; fastening a swing support beam to the horizontal frame beam with a swing bracket; and connecting a ladder to one of the horizontal deck support beams with ladder brackets. Most desirably, the method further includes the step of connecting a climbing wall to one of the horizontal deck support beams with additional ladder brackets.

The first and second frame brackets are not only usable separately but are also utilized together with overlapping wall portions such as side walls which overlap thereby allowing beams to be placed therethrough which secures the beams together and prevents rotation of one beam relative to the other. Holes for receiving fasteners through the brackets are useful to secure the beams to the brackets so that the brackets do not move relative to the beams.

Similarly, deck support brackets are useful together with either the first and second frame brackets. By providing the slot over one of the wall portions of either the first and second brackets beams can constrained by the brackets. Using these brackets overlap bracket wall portions are located intermediate adjacent beams.

The swing support bracket can function somewhat similarly by itself in that its base functions as the panel intermediate adjacent beams. When beams are installed with this bracket the beams are securely held in position relative to one another. Using these brackets at least some of the stresses on the brackets are carried by sheer load on the fasteners through the holes in the brackets, if at all.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
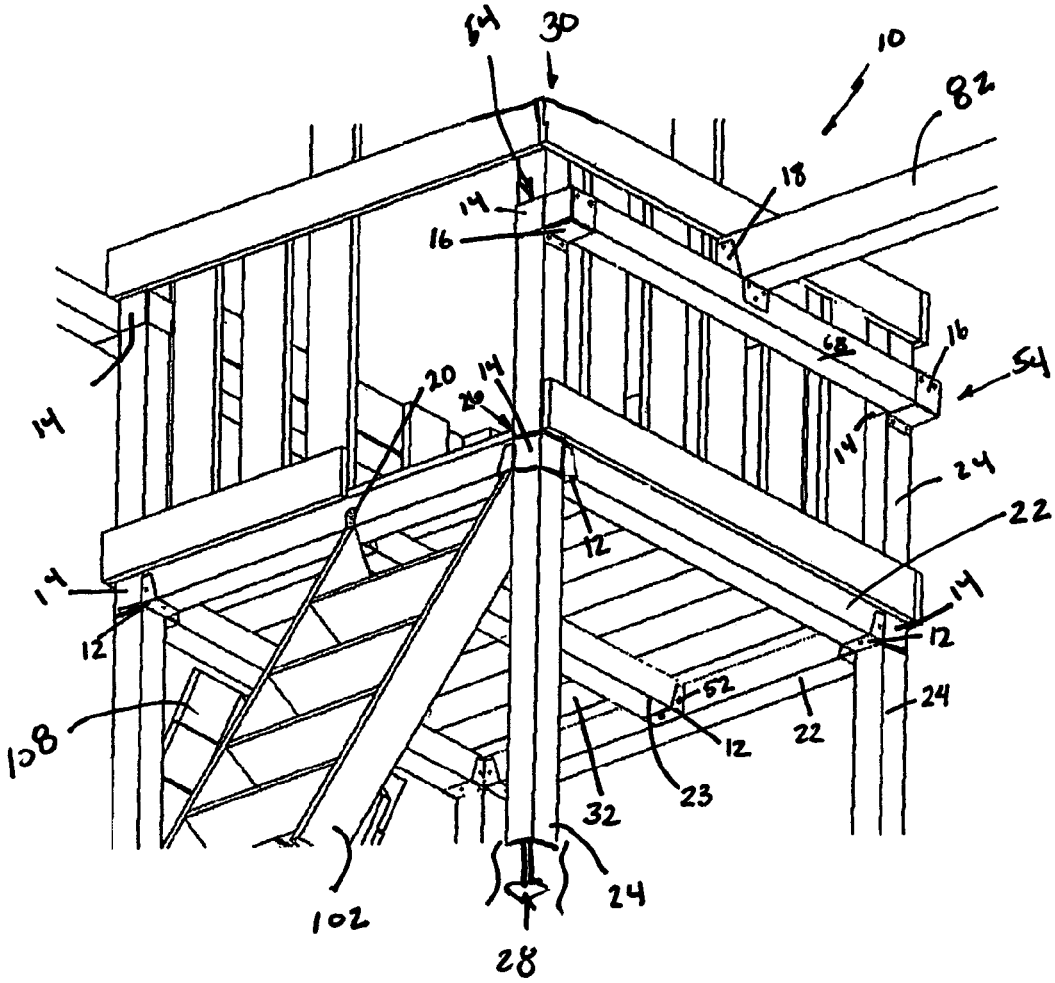
FIG. 1 is a perspective view of a piece of playground equipment assembled with a bracket system and brackets according to the preferred embodiment of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring to the figures, and in particular FIG. 1, there is shown a piece of playground equipment 10, assembled with the bracket system of the present invention. The bracket system includes deck support brackets 12, vertical frame brackets 14, horizontal frame brackets 16, swing brackets 18, and ladder brackets 20. The plurality of deck support brackets 12 secure a plurality of horizontal deck support beams 22 to a plurality of vertical frame beams 24 at first points 26 along the vertical frame beams. Preferably, the first point 26 is located approximately at a midpoint between a bottom 28 and a top 30 of the vertical frame beams 24. The vertical frame beams 24 provide stability in addition to holding up the playground equipment 10. At least one middle support beam 23 connected to opposing deck support beams 22 with at least two deck support brackets further stabilizes the equipment 10. A deck 32 attaches to and is mounted on the horizontal deck support beams 22 and the middle support beam 23.

Most preferably, the bracket system uses a total of ten deck support brackets 12. Eight of the deck support brackets 12 secure four deck support beams 22 to four vertical frame beams 24, so that two deck support brackets are fixed to each deck support beam 22. The remaining two deck support brackets secure a middle support beam 23 to two opposing deck support beams 22 underneath the deck 32 to further stabilize the equipment 10. In this configuration, one deck support bracket 12 is attached to a left side of each deck support beam 22, and one deck support bracket is attached to a right side 36 of each deck support beam. Two deck support bracket 12 then may be attached to adjacent sides of each of the four vertical frame beams 24. As shown in FIG. 1, the deck support brackets 12 may be connected to the first frame brackets 14 or the second frame brackets 16 in a similar manner.

Figure 2:
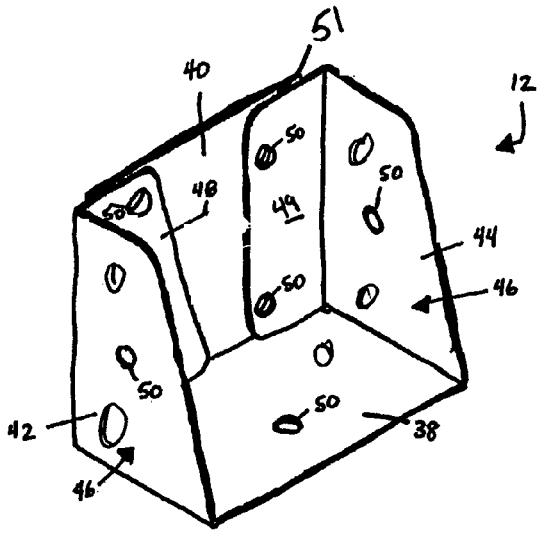
FIG. 2 shows a perspective view of a deck support bracket used in the bracket system of the present invention.

FIG. 2 depicts a deck support bracket 12 in accordance with the principles of the present invention. The deck support bracket 12 preferably is composed of a single piece of material, folded or bent to include a base 38, a back 40 perpendicularly oriented to the base, and left and right sloping sides 42, 44. Most preferably, the deck support bracket 12 is made of a durable metal and/or plastic material. Outer portions 46 of the left and right sides 42, 44 are substantially perpendicular to both the base 38 and the back 40, but inner portions of the left and right sides fold perpendicularly to the outer portions, overlapping the back forming flaps 48,49. The base 38, back 40, and left and right sides 42, 44 and flaps 48, 49 include openings 50 for receiving fasteners, such as screws, bolts, or the like. The flaps 48, 49 are separated from the back 40 by slot 51. The slot 51 is useful in connecting with one of the first and second frame brackets 14, 16 as will be described in detail below.

Returning to FIG. 1 and the bracket system, at least two vertical frame brackets 14 are attached to at least two adjacent vertical frame beams 24 at second points 54 along the vertical frame beams and above the first points 26. Preferably, the second points 54 are located approximately at a midpoint between the first points 26 and a top 30 of the vertical frame beams 24. Most preferably, the bracket system uses a total of two vertical frame brackets 14, each attached to one of two separate and adjacent vertical frame beams 24 at the second points 54.

Figure 3:
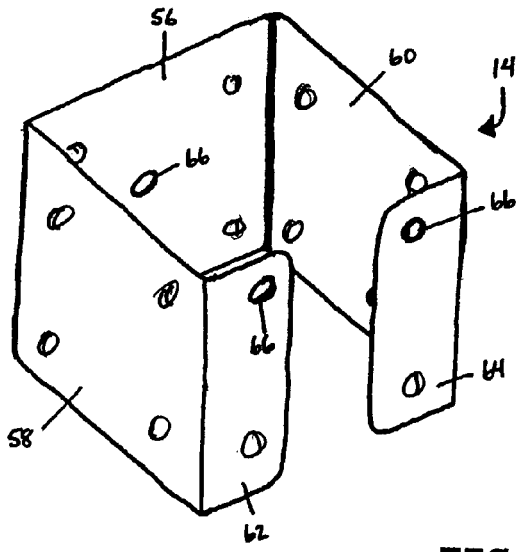
FIG. 3 illustrates a perspective view of a vertical frame bracket used in the bracket system of the present invention.

FIG. 3 illustrates a first or vertical frame bracket 14 in accordance with the principles of the present invention. The vertical frame bracket 14 preferably is composed of a single piece of material, folded or bent to include a back 56, left and right side walls 58, 60 perpendicular to the back, and short left and right front walls 62, 64 perpendicular to the side walls and extending towards each other. Most preferably, the vertical frame bracket 14 is made of a durable metal and/or plastic material. The back 56, side walls 58, 60 and left and right front walls 62, 64 preferably include openings 66 for receiving fasteners 52, such as screws, bolts, or the like.

Again returning to FIG. 1 and the bracket system, at least two horizontal frame brackets 16 fix at least one horizontal frame beam 68 to the at least two vertical frame beams 24 at the second points 54. The at least two horizontal frame brackets 16 and the at least two vertical frame brackets 14 interconnect as will be described below. Preferably, the bracket system uses a total of two horizontal frame brackets for fixing a single horizontal frame beam to both of two separate and adjacent vertical frame beams 24 at the second points 54.

Figure 4:
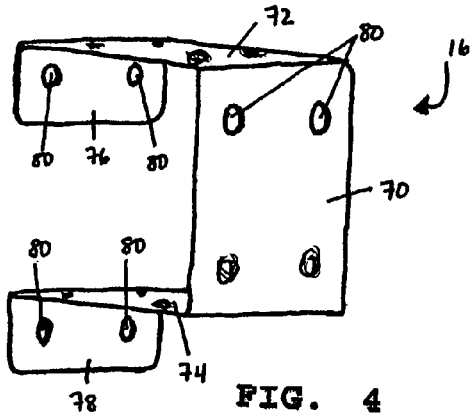
FIG. 4 depicts a perspective view of a horizontal frame bracket used in the bracket system of the present invention.

FIG. 4 shows a second or horizontal frame bracket 16 in accordance with the principles of the present invention. The horizontal frame bracket 16 preferably is composed of a single piece of material, folded or bent to include a back 70, upper and lower side walls 72, 74 perpendicular to the back, and short upper and lower front walls 76, 78 perpendicular to the side walls. Most preferably, the horizontal frame bracket 16 is made of a durable metal and/or plastic material. The upper front wall 76 extends toward the lower front wall 78 and depends from the upper side wall 72, but the lower front wall extends away front the upper front wall and depends from the lower side wall 74. The back 70, side walls 72, 74 and the upper and lower front walls 76, 78 include openings 80 for receiving fasteners 52 such as screws, bolts, or the like.

A swing bracket 18 fastens a swing support beam 82 to the at least one horizontal frame beam 68 at a third point 84 along the at least one horizontal frame beam, as seen in FIG. 1. Preferably, the third point 84 is located approximately at a midpoint between the at least two horizontal frame brackets 16. Most preferably, a single swing bracket 18 fastens the swing support beam 82 to a single horizontal frame beam 68 at the third point 84.

Figure 5:
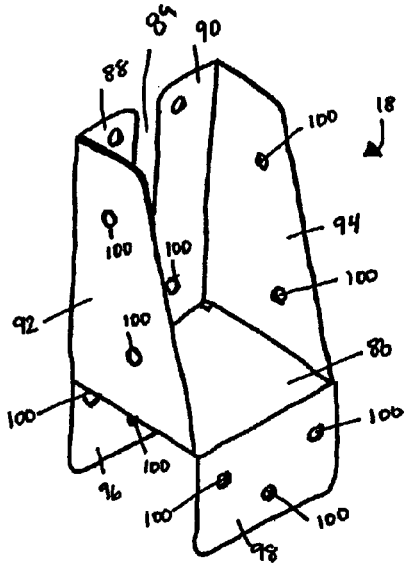
FIG. 5 is a perspective view of a swing bracket used in the bracket system of the present invention.

FIG. 5 depicts a swing bracket 18 in accordance with the principles of the present invention. The swing bracket 18 preferably is composed of a single piece of material, folded or bent to include a base 86, left and right upper back walls 88, 90 extending toward each other and perpendicular to the base, defining channel 39 therebetween left and right sloping side walls 92, 94 perpendicular to the left and right upper back walls, a lower back wall 96 perpendicular to the base and depending therefrom, and a lower front wall 98 perpendicular to the base and depending therefrom. Most preferably, the swing bracket 18 is made of a durable metal and/or plastic material. The left and right upper back walls 88, 90, the left and right sloping side walls 92, 94, the lower back wall 96, and the lower front wall 98 include openings 100 for receiving fasteners 52 such as screws, bolts, or the like.

Turning again to FIG. 1 and the bracket system, at least two ladder brackets 20 connect a ladder 102 to one of the plurality of horizontal deck support beams 22. Preferably, the bracket system uses a total of two ladder brackets 20, each attached to one of two legs 104, 106 of the ladder 102, and to one of the four horizontal deck support beams 22. In a preferred embodiment, additional ladder brackets 20 also may be used to connect a climbing wall 108 to one of the plurality of horizontal deck support beams 22. Most preferably, the bracket system uses two additional ladder brackets 20, each attached to the climbing wall 108, and to one of the four horizontal deck support beams 22. If both a ladder 102 and a climbing wall 108 are included with the piece of playground equipment 10, the ladder and the climbing wall should be connected to separate horizontal deck support beams 22. Such beams 22 may be adjacent, opposite, or unrelated to each other.

Figure 6:
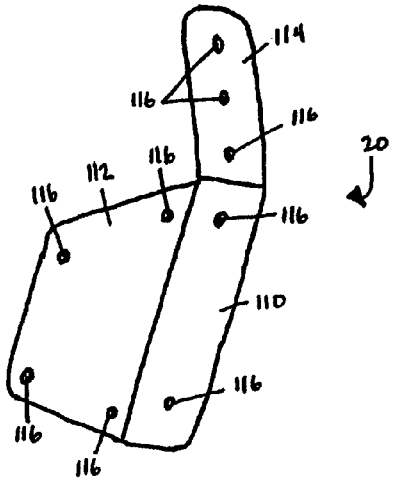
FIG. 6 shows a perspective view of a ladder bracket used in the bracket system of the present invention.

FIG. 6 illustrates a ladder bracket 20 in accordance with the principles of the present invention. The ladder bracket 20 preferably is composed of a single piece of material, folded or bent to include a back 110, a sloping side wall 112 perpendicular to the back, and a top wall 114 at an obtuse angle to the back. Most preferably, the ladder bracket 20 is made of a durable metal and/or plastic material. The back 110, the side wall 112, and the top wall 114 all include openings 116 for receiving fasteners 52 such as screws, bolts, or the like.

A method of assembling a piece of playground equipment 10 using the bracket system of the present invention also is disclosed. The method includes the steps of securing a plurality of horizontal deck support beams 22 to a plurality of vertical frame beams 24 at first points 26 along the vertical frame beams with a plurality of deck support brackets 12 and fasteners; attaching at least two vertical frame brackets 14 to at least two adjacent vertical frame beams at second points 54 along the vertical frame beams above the first points with fasteners; fixing at least one horizontal frame beam 68 to the at least two adjacent vertical frame beams at the second points with at least two horizontal frame brackets 16 and fasteners; interconnecting the at least two horizontal frame brackets and the at least two vertical frame brackets; fastening a swing support beam 82 to the at least one horizontal frame beam at a third point 84 along the at least one horizontal frame beam with a swing bracket 18 and fasteners; and connecting a ladder 102 to one of the plurality of horizontal deck support beams with at least two ladder brackets 20 and fasteners.

Preferably, the first points 26 described in the above method are located approximately at a midpoint between a bottom 28 and a top 30 of the vertical frame beams 24. The second points 54 preferably are located approximately at a midpoint between the first points 26 and a top 30 of the vertical frame beams 24. The third point 84 preferably is located approximately at a midpoint between the at least two horizontal frame brackets 16. Most preferably, the method of assembling a piece of playground equipment 10 using the bracket system of the present invention further includes the step of connecting a climbing wall 108 to one of the plurality of horizontal deck support beams 22 with at least two additional ladder brackets 20 and fasteners.

Figure 7:
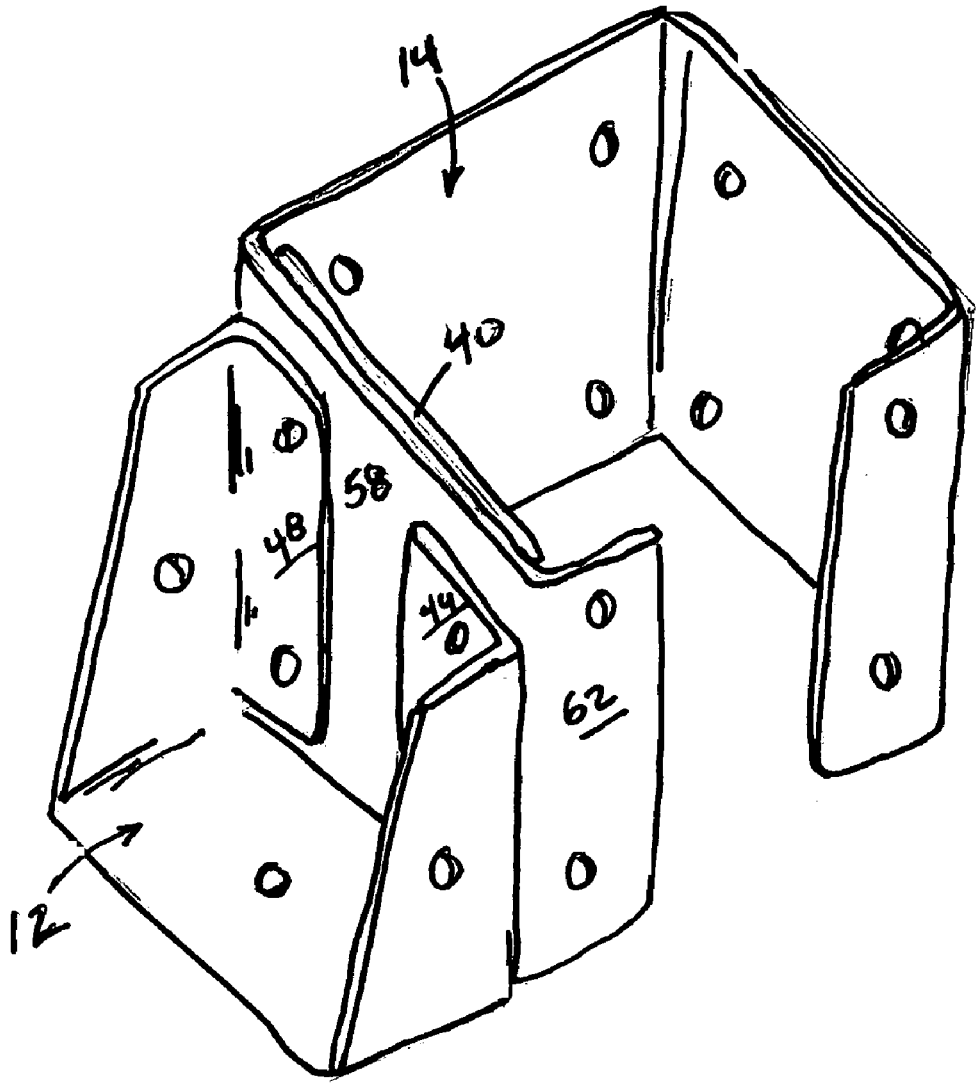
FIG. 7 shows a perspective view of a deck support bracket connected to a second frame bracket.
Figure 8:
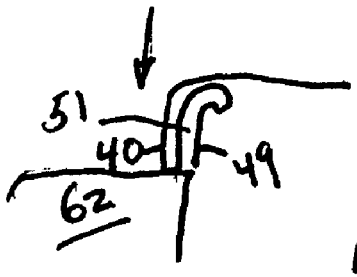
FIG. 8 shows a detailed side view of a portions of the bracket shown in FIG. 7 showing the installation of the deck bracket relative to the second frame bracket.

FIG. 7 shows the interlocking nature of the deck support bracket 12 with the first frame support bracket 14. The back 40 of the deck support bracket 12 is located on one side of the left side wall 58 while the flaps 48, 49 are located on the other side of the left side wall 58. This allows the left side wall 58 to be received within the slot 51 as shown in FIG. 8. The holes 50 extend through both of the flaps 48, 49, and the back 40. The holes 66 in the first frame member 14 preferably coincide and/or overlap with the holes 50. Accordingly, fasteners can be provided through any of the holes 50, 66 into an appropriate beam.

Figure 9:
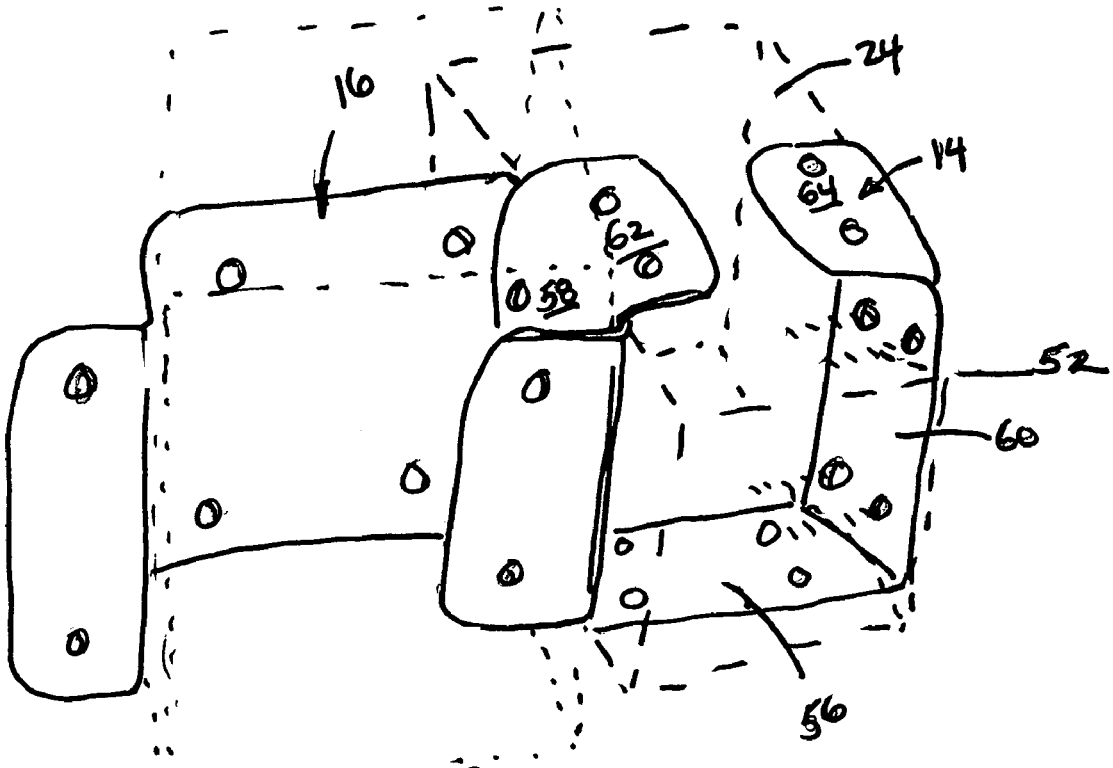
FIG. 9 shows the first and second frame brackets connected together with the inserted beams removed.

FIG. 9 shows first and second frame brackets 14, 16 interconnected as could occur at a portion of a beam such as shown at position 54 in FIG. 1 or elsewhere. Of course, any of the sides 58, 60, front walls 62, 64, or back 56 could interface with the side wall 72, 74 back 70 or even front wall 76 as illustrated in FIG. 1. Since the holes 80 as shown in FIG. 4 overlap with the holes 66 as shown in FIG. 3 with adjacent panels placed next to one another in overlapping context, it should be easy to see that the fastener such as screws or bolts 52 as shown in FIG. 9 can be placed through the holes into beams such as illustrated beam 24 shown in phantom in FIG. 9. One skilled in the art will see as shown in FIG. 9 that the side wall 58 is in contacting engagement with the side wall 72 of the second bracket 16. When another beam is inserted under the second bracket 16, the brackets 14, 16 resist rotation relative to one another due to the interlocking nature of the brackets 14, 16. In a similar manner, as the deck support brackets 12 cooperate with either of the first or second brackets 14, 16 as described above with reference to FIGS. 7 and 8.

Although the swing support bracket 18 shown in FIG. 5 does not have overlapping walls with one another, this bracket could be used with either of the frame brackets 14, 15 shown in FIG. 3 and FIG. 4 or by itself as illustrated in FIG. 1. By using the construction interlocking brackets or the swing support bracket 18, the weight load on the bracket tends to be applied to through sheer stresses on fasteners instead of on threads of a bolt through a single bore as is experienced through prior art drilled of beams connected with bolts and nuts. In testing, it has been discovered that the brackets of the present invention can support 4600 pounds of loan and are not the weak link. By utilizing these brackets, pre-drilling of holes in beams can be eliminated in many instances. This can result in a significant savings for the purchaser since appropriate length lumber can be relatively quickly assembled utilizing the brackets as shown and described herein. Assembly tools can be reduced to a drill or screwdriver and possibly a saw.

Referring back to FIG. 5, the positioning of the base 86 intermediate to beams as illustrated in FIG. 1 with the side walls 92, 94 connected to the swing support beam 82 and the low front and back walls 96, 98 connected to the horizontal frame beam 62 as shown in FIG. 1. Resistance to rotation of the swing support beam 82 is established by the use of the swing support bracket 18.

Accordingly, the use of either cooperating brackets or the swing support bracket is useful in providing rotation of joining beams. This is believed to be a significant advantage over the use of bolts through single bores at the ends of beams as is commonly utilized in the art. Most manufacturers that provide pre-drilled beams instruct owners to regularly tighten the nuts on bolts. Failure to regularly tighten these nuts could result in a nut becoming loose over time thereby allowing rotation of one beam relative to another. Since the load on the brackets shown in the structure are primarily distributed as sheer stress on the fasteners extending through the respective holes, there is no ability for the adjacent beams to rotate relative to one another even if the fasteners begin to back out over time which is extremely unlikely since the stress acts on the sheer of the fasteners.

A preferable method of assembling playground equipment with a bracket system includes the steps of securing four horizontal deck support beams 22 to four vertical frame beams 24 at first points 26 along the vertical frame beams with eight deck support brackets 12 and fasteners 52; connecting a middle support beam 23 to two opposing horizontal deck support beams 22 underneath the deck 32 with two deck support brackets 12 and fasteners 52; attaching two vertical frame brackets 14 to two adjacent vertical frame beams at second points 54 along the vertical frame beams above the first points; fixing a horizontal frame beam 68 to the two adjacent vertical frame beams at the second points with two horizontal frame brackets 16 and fasteners; interconnecting the two horizontal frame brackets and the two vertical frame brackets; fastening a swing support beam 82 to the horizontal frame beam at a third point 84 along the horizontal frame beam with a swing bracket 18 and fasteners; connecting a ladder 102 to one of the horizontal deck support beams with two ladder brackets 20 and fasteners; and connecting a climbing wall 108 to another of the horizontal deck support beams with two additional ladder brackets and fasteners.

A piece of playground equipment 10 designed to be assembled with the bracket system of the present invention includes at least the following pieces: horizontal deck support beams 22, vertical frame beams 24, a deck 32, a horizontal frame beam 68, a swing support beam 82, a ladder 102, and the bracket system, which includes a plurality of deck support brackets, at least two vertical frame brackets, at least two horizontal frame brackets, a swing bracket, and at least two ladder brackets. Optionally, the piece of playground equipment 10 also may include a climbing wall 108 and at least two additional ladder brackets. It is noted that the piece of playground equipment shown in FIG. 1 is only one embodiment of playground equipment constructed with the present bracket system. Other styles of playground equipment 10 assembled with the subject bracket system could include other or additional play units, designs, or modules while still falling within the scope of the present invention. As an example, FIG. 2 depicts an alternate piece of playground equipment 10 assembled with the subject bracket system.

The bracket system of the present invention allows a piece of playground equipment 10 to be assembled easily and quickly, without professional assistance. The modular nature of the various components and brackets of the present piece of playground equipment allows for easy transportation and storage.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A bracket system comprising:

a first and second wood beam;

a first bracket having first, second, third, and fourth walls; said second and third wall connected on opposing sides of the first wall, the third wall parallel to the second wall and perpendicular to the first wall, and the fourth wall parallel to the first wall and connected directly to one of second and third walls, said fourth wall perpendicular to the second and third walls; and a second bracket having first, second, third, and fourth walls; said second and third wall connected on opposing sides of the first wall, the third wall parallel to the second wall and perpendicular to the first wall, and the fourth wall parallel to the first wall and connected directly to one of second and third walls, said fourth wall perpendicular to the second and third walls;

wherein at least one of the fourth walls of the first and second bracket is separated by a channel from the first wall, and a first selected one of the second, third and fourth walls of the first bracket overlaps a second selected one of the second, third and fourth walls of the second bracket in an installed configuration providing adjacent first and second selected ones and the first bracket is connected to the first beam and the second bracket is connected to the second beam with the first selected one is between the second selected one and the second beam and the second selected one is between the first selected one and the first beam.

2. The bracket system of claim 1 wherein the first and second selected ones have at least two sets of aligning holes providing access for a fastener to be inserted therethrough.

3. The bracket system of claim 1 wherein the fourth wall of the first bracket is integrally connected to the second wall, and further comprising a fifth wall integrally connected to the third wall, said fifth wall parallel to and coplanar with the fourth wall, and the first, second and third walls are integrally connected together.

4. The bracket system of claim 3 wherein the fourth wall of the second bracket is integrally connected to the second wall, and further comprising a fifth wall integrally connected to the third wall, said fifth wall parallel to the fourth wall, and the first, second and third walls are integrally connected together.

* * * * *